US005331772A

United States Patent [19]

Steere, III et al.

[11] Patent Number: 5,331,772

[45] Date of Patent: Jul. 26, 1994

[54] SEAL ASSEMBLY FOR A WAFER GRINDING MACHINE

[75] Inventors: Robert E. Steere, III, Boonton, N.J.; Thomas E. Leonard, Vernon, Conn.

[73] Assignee: Silicon Technology Corp., Oakland, N.J.

[21] Appl. No.: 911,265

[22] Filed: Jul. 7, 1992

Related U.S. Application Data

[60] Continuation of Ser. No. 700,619, May 15, 1991, abandoned, which is a division of Ser. No. 343,064, Apr. 25, 1989, Pat. No. 5,036,628.

[51] Int. Cl.[5] ..... B24B 9/00

[52] U.S. Cl. ..... 51/268; 51/270; 51/105 R

[58] Field of Search ..... 51/268, 270, 274, 272, 51/105 R, 105 LG, 106 R, 273, 424, 418; 15/257 R

[56] References Cited

U.S. PATENT DOCUMENTS

| | | | |
|---|---|---|---|
| 2,622,309 | 12/1952 | Hauk | 51/273 |
| 3,148,488 | 9/1964 | Reaser | 51/272 |
| 3,466,811 | 9/1969 | Suddarth | 51/268 |
| 3,553,910 | 1/1971 | Hordis | 51/356 |
| 4,241,505 | 12/1980 | Bodycomb et al. | 30/390 |
| 4,251,171 | 2/1981 | Brett | 51/268 |
| 4,308,630 | 1/1982 | Schmidt | 51/274 |
| 4,638,601 | 1/1987 | Steere et al. | 51/165.71 |
| 4,782,591 | 11/1988 | DeVito et al. | 30/123.3 |

FOREIGN PATENT DOCUMENTS

| | | |
|---|---|---|
| 0253910 | 11/1912 | Fed. Rep. of Germany . |
| 2061184 | 5/1981 | United Kingdom . |

*Primary Examiner*—M. Rachuba
*Attorney, Agent, or Firm*—Francis C. Hand

[57] ABSTRACT

A seal assembly for a wafer grinding machine is mounted on a housing in which a grinding wheel is contained. The seal assembly is formed of a pair of flexible strips which are secured over an opening in a plate mounted on a housing enclosing the grinding wheel for sealingly engaging a respective planar surface of a wafer which is introduced through the opening by a rotatable chuck. The edges of the sealing strips define a V-shaped gap to ensure that the edges are disposed in biased relation against each other and against a wafer which passes between the strips. A tube provided with perforations is disposed to blow air to clear debris from the wafer.

13 Claims, 4 Drawing Sheets

SEAL ASSEMBLY FOR A WAFER GRINDING MACHINE

This is a continuation of application Ser. No. 07/700,619 filed on May 15, 1991, which is a division of Ser. No. 07/343,064, filed Apr. 25, 1989, now U.S. Pat. No. 5,036,628.

This invention relates a seal assembly for a wafer grinding machine.

As is known, various types of machines have been provided for the grinding of an edge of a wafer such as a silicon wafer, for example, into a parabolic profile. For example, U.S. Pat. No. 4,638,601 describes an automatic edge grinder having a grinding station in which a wafer is held and rotated while a grinding wheel grinds the edge of the wafer into a desired shape.

As is known, during the grinding of the edge of a wafer, debris from the wafer edge as well as from the grinding wheel is formed. Further, it is also known that this debris must be prevented from depositing onto the planar surfaces of the wafer as such could destroy the usability of the wafer in forming semi-conductor chips. Accordingly, various techniques have been employed to remove any such debris from the grinding environment of a grinding machine or to otherwise preclude depositing of the debris onto the surfaces of the wafer. For example, as described in U.S. Pat. No. 4,638,601, the wafer to be ground has been held between a head and a chuck via annular lip seals while compressed air has been blown through the head as well as the chuck in order to deliver a flow of air for blowing ground particles from the surfaces of the wafer outwardly of the annular lip seals. In addition, the head and chuck have been disposed within a housing which can be closed and evacuated during a grinding operation to draw off ground particles.

It is an object of this invention to improve the cleanliness of a grinding stage of a grinding machine.

It is another object of the invention to prevent debris from depositing onto the surfaces of a wafer being edge ground.

It is another object of the invention to effectively seal a grinding station of a wafer grinding machine relative to the edge of a wafer being ground.

It is another object of the invention to provide a relatively simple seal assembly for a grinding station in a grinding machine.

It is another object of the invention to provide a removable seal assembly for a grinding station of a wafer grinding machine.

Briefly, the invention provides a seal assembly for a wafer grinding machine which comprises a support plate having an elongated opening for passage of a peripheral edge of a wafer and a pair of flexible strips secured to the plate in overlapping relation to the opening for sealingly engaging a respective planar surface of the wafer projecting through the opening. Each strip also has a free edge disposed in abutting relation to a free edge of the other strip so as to define a V-shaped gap between the strips which is aligned with the opening in the support plate.

The edges of the sealing strips by being disposed in abutting relation to define a V-shaped gap ensures that the edges are disposed in biased relation against each other and against a wafer which passes therebetween. As such, the strips are preloaded against each other due to the springiness of the strips. In addition, with a wafer passing through and between the strips, the edges of the strips are able to seal off the remainder of the opening in the plate.

The flexible strips are made of a material which is not affected by coolants in particularly those that contain caustic material and, in particular, is made of a material which does not wrinkle. For example, the strips may be made of a polytetrafluoroethylene (Teflon), polyurethane or any suitable flexible elastomer.

The seal assembly is also provided with a means for blowing air across the support plate on a side opposite to the edges of the strips in order to clear debris from the wafer. This means may employ a tube which is provided with spaced apart perforations for blowing-air across the support plate.

The seal assembly is particularly useful in a wafer grinding machine having a rotatable chuck for receiving and holding a wafer and a grinding wheel for grinding an edge of the wafer. In this case, the seal assembly is disposed between the chuck and the grinding wheel for sealing against the surfaces of the wafer on the chuck during grinding of an edge of the wafer in order to seal these surfaces from the debris ground from the edge of the wafer. In this respect, the grinding machine may have a housing in which the grinding wheel and seal assembly are mounted in movable relation to the chuck. The housing may also be provided with a means for evacuating the housing to remove debris ground from the edge of the wafer.

When in use, a chuck or any other suitable means may be used for holding a wafer in alignment with the opening in the plate of the seal assembly while the grinding wheel is moved toward the wafer. As the seal assembly approaches the edge of the wafer, the wafer projects through the seal assembly into the interior of the housing and is positioned so as to be ground by the grinding wheel. During the subsequent grinding of the edge of the wafer, the debris which is produced is confined to the space within the housing since the sealing strips of the seal assembly prevent the debris from passing out of the opening through which the wafer projects. Further, any debris which deposits on the exposed portion of the wafer within the housing is wiped from the edge portion during passage through the edges of the flexible strips and out of the housing.

The seal assembly is constructed so that the support plate on which the flexible strips are mounted can be readily removed from the housing of the grinding machine. For example, the support plate may be mounted on a mounting plate which is fixed relative to the housing. For example, the support plate may be secured in place by screws which, upon loosening, permits the support plate to be slid upwardly from the mounting plate and out of the grinding machine. A support plate with a fresh pair of flexible strips can then be inserted and secured to the mounting plate.

These and other objects and advantages of the invention will become more apparent from the following detailed description taken in conjunction with the accompanying drawings wherein.

Figure 1:
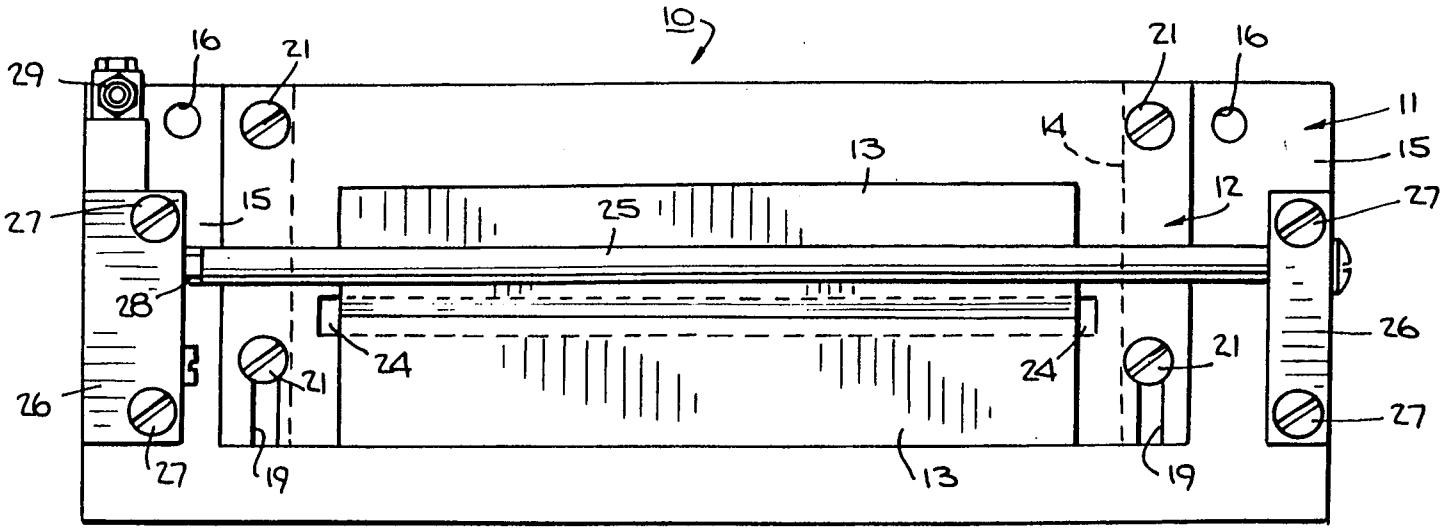
FIG. 1 illustrates a front view of a seal assembly constructed in accordance with the invention.
Figure 2:
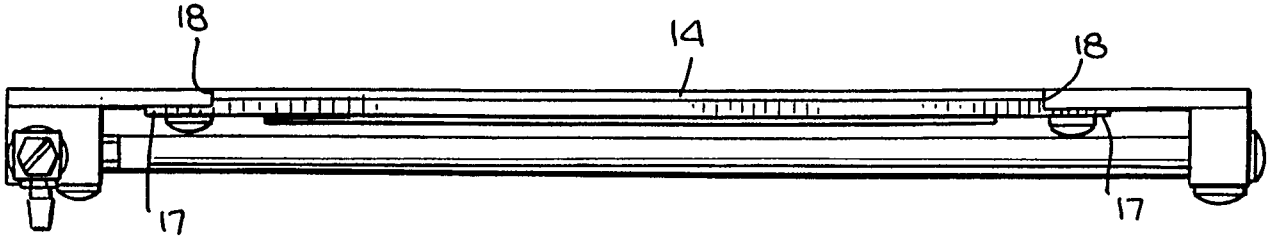
FIG. 2 illustrates a top view of the seal assembly of FIG. 1.

Referring to FIGS. 1 and 2, the seal assembly 10 includes a mounting plate 11, a support plate 12 and a pair of flexible strips 13 which are secured to the support plate 12.

Figure 3:
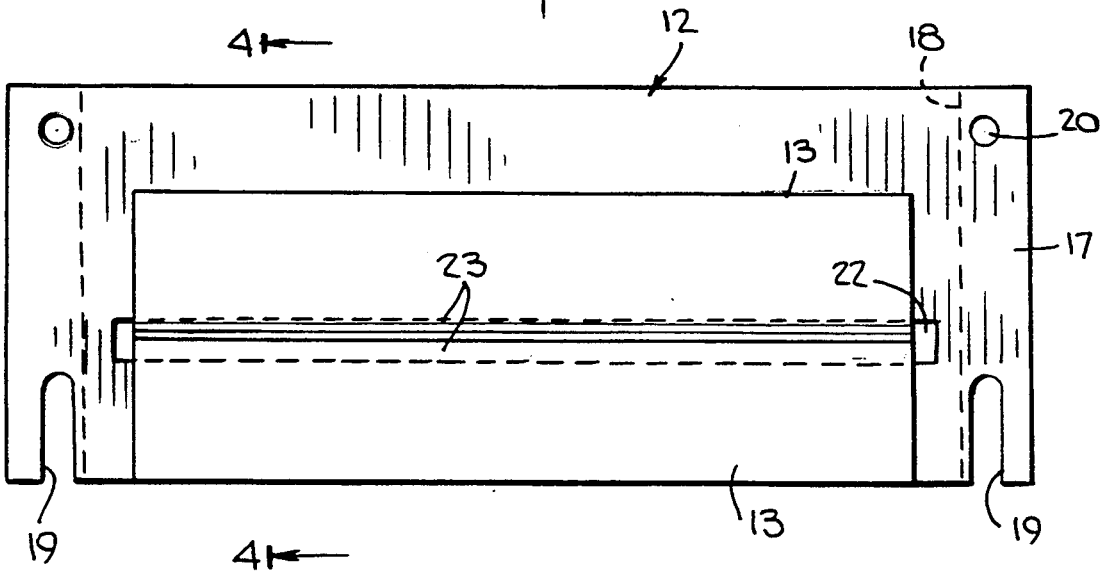
FIG. 3 illustrates a front view of a support plate with a pair of flexible strips thereon in accordance with the invention.
Figure 5:
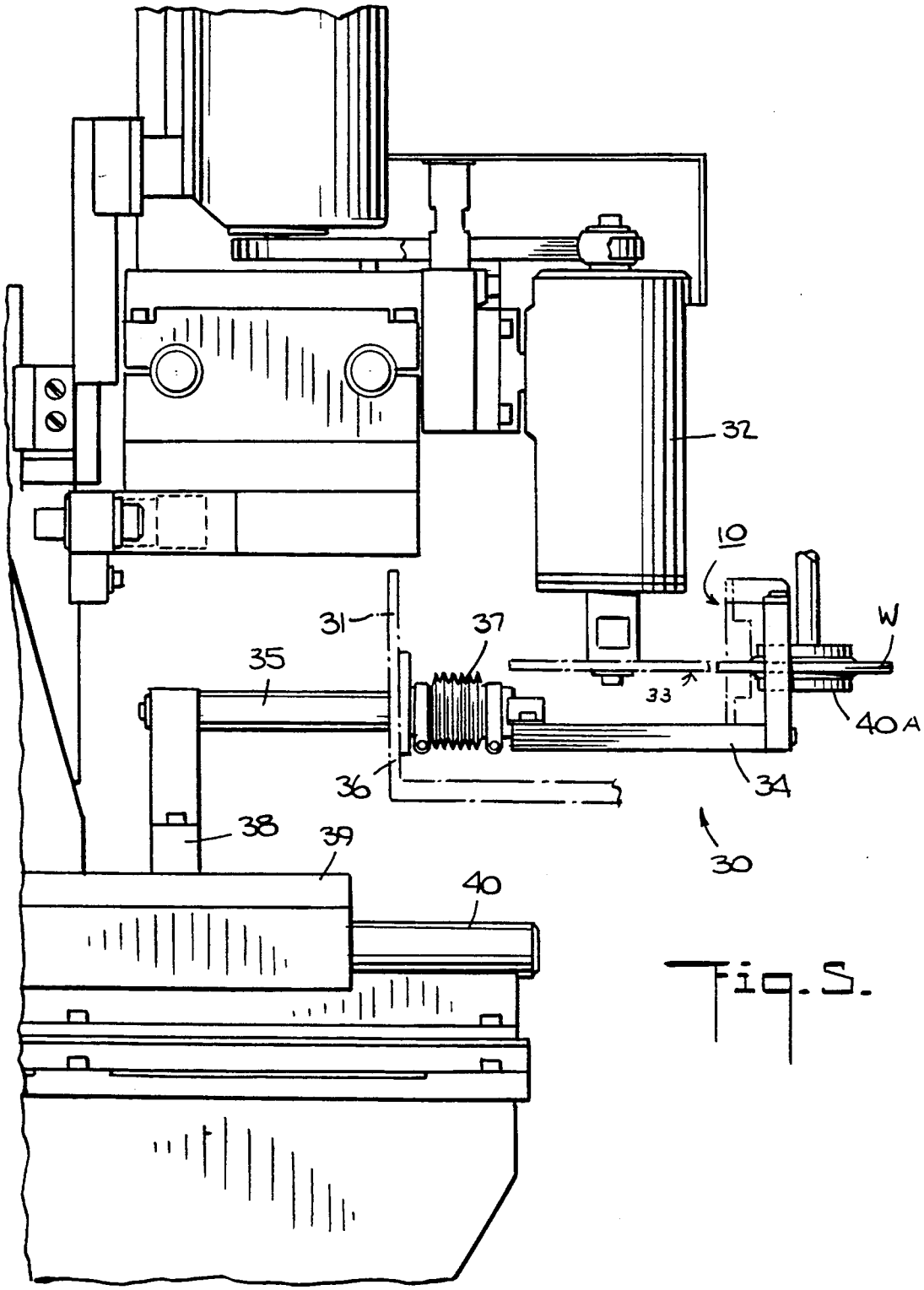
FIG. 5 illustrates a partial side view of a wafer grinding machine employing a seal assembly in accordance with the invention.

The mounting plate 11 is flat and of U-shape to define a central recess 14 between two upstanding legs 15. In addition, each leg 15 has an aperture 16 for the passage of a mounting screw for mounting of the seal assembly in a grinding machine (FIG. 5). Referring to FIG. 3, the support plate 12 is of flat rectangular shape with opposite ends 17 of less thickness than the remainder of the support plate 12 in order to slide into the recess 14 of the mounting plate 11. As indicated in FIG. 2, the support plate 12 has a shoulder 18 at each end 17 for engaging against the mounting plate 11. Also, as illustrated in FIG. 3, each end 17 of the support plate 12 has a slot 19 at a lower end and an opening 20 at an upper end.

Referring to FIG. 1, the support plate 12 is releasably secured to the mounting plate 11 by four screws 21 which pass through the slots 19 and openings 20 of the support plate 12 into threaded bores (not shown) in the mounting plate 11.

In order to remove the support plate 12 from the mounting plate 11, the two top screws 21, as viewed in FIG. 1 are unthreaded from the mounting plate 11. Next, the two lower screws 21 are loosened to permit the support plate 12 to be slid upwardly, as viewed, away from the mounting plate 11.

Figure 4:
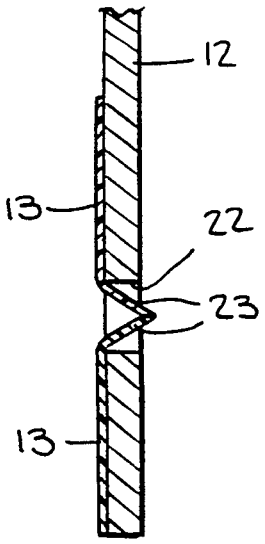
FIG. 4 illustrates a view taken on line IV—IV of FIG. 3.

Referring to FIG. 3, the support plate 12 is provided with an elongated opening 22 of substantially rectangular shape with squared ends while the flexible strips 13 are secured to the plate 12 in overlapping relation to the opening 22. In addition, each strip 13 has a free edge 23 (see FIG. 4) which is disposed in abutting relation to the free edge of the other strip 13 in order to define a V-shaped gap between the strips 13 which is aligned with the opening 22 in the plate 12. As indicated, in FIG. 4, the strips 13 are disposed on one side of the plate 12 with the free edges 23 projecting through the opening 22 of the plate 12.

The strips 13 are made of a material which is not affected by coolants which contain caustic materials. In addition, the flexible strips 13 are characterized in being made of a wrinkle resistant material that the strips 13 maintain a reliable seal at all times. For example, the strips 13 may be made of Teflon, polyurethane and flexible elastomers having these properties.

The strips 13 are of a length to extend over a substantial portion of the opening 22 with relatively small gaps 24 being formed at the ends of the opening 22.

The opening 22 is sized so as to receive the free edges 23 of the strips 13 as well as a wafer (not shown) disposed in sealing relation between the free edges 23.

The strips 13 may be secured to the support plate 12 in any suitable manner. For example, each strip 13 may be provided with a self-adhesive surface for engaging against the plate 12 while the free edges 23 are void of any adhesive material so as to preclude any sticking to the walls defining the opening 22 in the plate 12.

Referring to FIGS. 1 and 2, the seal assembly 10 also has a means for blowing air across the support plate on a side opposite from the edges of the strips 13 in order to clear debris from away the wafer being ground. This means includes a tube 25 which extends parallel and adjacent to the opening 22 in the plate 12. This tube 25 includes a plurality of perforations (not shown) for blowing air transversely of the opening 22 and across the support plate 12. The tube 25 is mounted on and between a pair of brackets 26 each of which is secured by a pair of screws 27 to the mounting plate 11. In addition, the left-hand bracket (as viewed) includes an air duct 28 which is in communication with the interior of the tube 25 and with an air inlet 29 mounted on the bracket 26. The air inlet 29 serves to direct a flow of air through the duct 28 in to the tube 25 and, thence, through the perforations (not shown) across the support plate 12.

Figure 6:
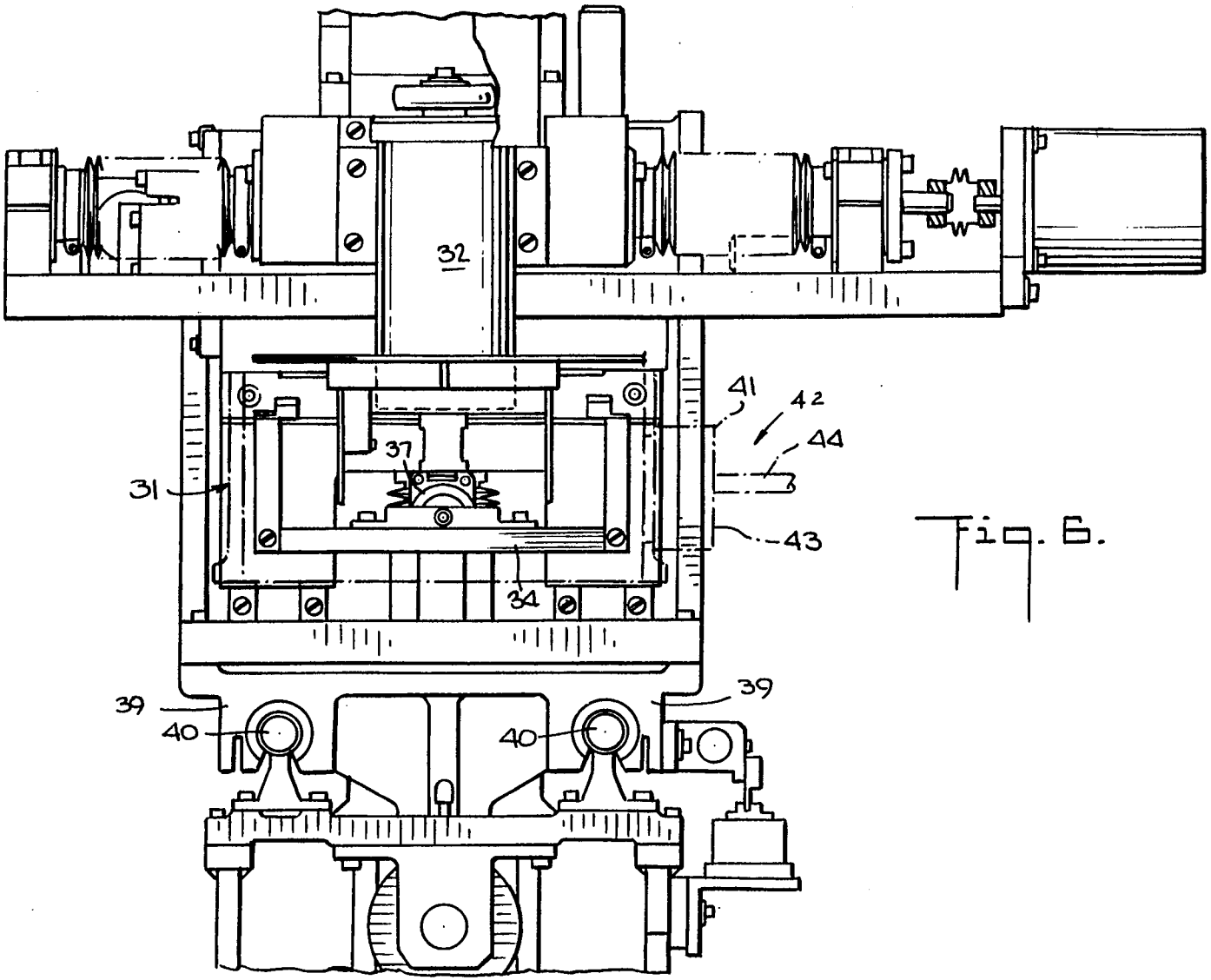
FIG. 6 illustrates a front view of the grinding machine of FIG. 5.

Referring to FIGS. 5 and 6, the seal assembly 10 is mounted in a grinding machine 30 similar to that as described in U.S. Pat. No. 4,638,601. To this end, the grinding machine 30 has a housing or tub 31 in which a spindle housing 32 for a grinding wheel 33 is disposed. In addition, the seal assembly 10 is mounted on a yoke 34 which is also disposed within the housing 31 in fixed longitudinal (forward-backward) relation to the grinding wheel 33. The yoke 34 is, for example, mounted on a rod 35 which passes through a wall 36 of the housing and which is sealed thereto by means of a bellows 37. The rod 35 is mounted by suitable brackets 38 on a carriage 39 which is reciprocably mounted on horizontal rails 40 by suitable means (not shown). The spindle housing 32 for the grinding wheel 33 is likewise mounted on the carriage 39 so as to be in fixed longitudinal relation with the seal assembly 10. Thus, the grinding wheel 33 and the seal assembly 10 are movable in common relative to a means 40A such as a rotatable chuck for holding a wafer W outside the housing 31.

Referring to FIG. 6, the housing or tub 31 has an opening in a side wall 41 which is in communication with a means 42 for evacuating the interior of the housing 31 in order to remove debris from around the edge of the wafer. For example, the means 42 may include a manifold 43 secured over the opening in the side wall 41 and a suction duct 44 which extends from the manifold 43 to a suitable vacuum source.

During use, the wafer W is deposited onto the rotatable chuck 40A with the grinding machine 30 being otherwise programmed for grinding a particular edge on the wafer W, for example as described in U.S. Pat. No. 4,638,601.

Next, the carriage 39 is moved horizontally in the longitudinal direction so as to move the grinding wheel 33 and seal assembly 10 towards the wafer W. As the seal assembly 10 approaches, the wafer W passes through the opening 22 in the support plate 12 (see FIG. 3) pushing the edges 23 of the strips 13 (see FIG. 4) away from each other. However, since the edges 23 are spring biased towards each other, sealing contact is maintained between each edge 23 and a respective planar face of the wafer W. In addition, the edges 23 remain in contact with each other where the wafer W does not pass through the strips 13, that is, beyond the ends of the chordal portion of the wafer which does pass through and between the strips 13.

The grinding wheel 33 is then brought into engagement with the edge of the wafer W and begins a grinding operation. As the wafer W rotates on the chuck 40A, portions of the peripheral edge of the wafer are brought into engagement with the grinding wheel 33.

The debris which occurs during grinding is retained within the housing 31 which is otherwise a sealed environment. For example, suitable shields and covers (not shown) can be secured to and mounted over the housing 31 to ensure a sealed environment.

In addition, during grinding, the means 42 for evacuating the housing 31 can be activated to withdraw the debris caused during grinding. In addition, a suitable coolant can be sprayed onto the grinding wheel and wafer during grinding in known manner. Mist from the spent coolant may also be withdrawn through the evacuation means 42 as is also known. The bulk of the spent coolant exits the tub 31 via a separate nozzle (not shown) on the floor of the tub 31.

Also, during operation, air is blown through the hollow tube 25 of the seal assembly 10 in order to blow any debris from the top planar surface of a wafer W.

Over time, the free edges 23 of the flexible strips 13 will become worn due to the movements of wafers therebetween. However, replacement of the strips 13 can be readily performed by releasing the support plate 12 from the mounting plate 11 (see FIG. 1) so that the support plate 12 and strips 13 can be moved out of the housing 31.

Since the free edges 23 of the flexible strips 13 are biased towards each other, an effective seal is maintained against the planar surfaces of a wafer W passing therethrough. In addition, as the seal assembly 10 moves away from a wafer W after grinding has been completed; the free edges 23 flex back into abutment with each other. Since the strips 13 are made of a material which does not wrinkle, the integrity of the free edges 23 is maintained without buckling as the seal assembly 10 is moved away from a wafer W. Further, since the strips 13 are wrinkle-proof, any coolant which falls unto the edges 23 does not cause the edges 23 to wrinkle or otherwise destroy the sealing effect between the edges 23 and the surfaces of a wafer W.

The invention thus provides a seal assembly which readily seals off a peripheral edge of a wafer which is being ground from the remainder of the wafer.

Further, the invention provides a seal assembly which can be readily incorporated into an existing grinding machine.

Still further, the invention provides a seal assembly which can be readily replaced from time to time in a grinding machine due to wear.

What is claimed is:

1. In a wafer grinding machine, the combination comprising a housing having an opening therein;

a rotatable chuck outside said housing for receiving and holding a wafer opposite said opening;

a grinding wheel mounted within said housing for grinding an edge of a wafer on said chuck; and a seal assembly mounted on said housing over said opening in said housing and between said chuck and said grinding wheel for sealing against planar surfaces of a wafer on said chuck when said wafer is passed through said seal assembly and said opening during grinding of an edge of the wafer to seal the planar surfaces from debris ground from the edge of the wafer within said housing.

2. The combination as set forth in claim 1 wherein said seal assembly includes a support plate extending perpendicularly between said chuck and said grinding wheel, said plate having an opening for passage of the edge of a wafer therethrough, and a pair of flexible strips secured to said plate over said opening for sealingly engaging a respective. planar surface of a wafer passing therethrough.

3. The combination as set forth in claim 2 wherein each said strip has a free edge disposed in abutting relation to a free edge of the other strip to define a V-shaped gap between said strips and aligned with said opening.

4. The combination as set forth in claim 3 wherein said edges of said strips project through said opening.

5. The combination as set forth in claim 2 which further comprises means for blowing air across said plate on a side opposite said grinding wheel to clear debris from a wafer.

6. The combination as set forth in claim 5 which further comprises a mounting plate between said chuck and said grinding wheel and having said support plate releaseably mounted thereon.

7. The combination as set forth in claim 6 wherein said means is mounted on said mounting plate and includes a tube extending parallel to said opening in said support plate, said tube having perforations for blowing air across said support plate.

8. The combination as set forth in claim 1 which further comprises a housing having said grinding wheel and said seal assembly mounted therein in fixed relation to each other.

9. In a wafer grinding machine, the combination comprising a housing;

a grinding wheel mounted in said housing for grinding an edge of a wafer; and a seal assembly mounted on said housing over an opening in said housing and adjacent said wheel for sealing against planar surfaces of a wafer passed therethrough during grinding of an edge of the wafer within said housing.

10. The combination as set forth in claim 9 wherein said seal assembly includes a plate having an opening for passage of the edge of a wafer therethrough, and a pair of flexible strips secured to said plate over said opening for sealingly engaging a respective planar surface of a wafer passing therethrough.

11. The combination as set forth in claim 10 which further comprises first means for holding a wafer in alignment with said opening in said plate and means for moving said grinding wheel and said seal assembly relative to said first means for grinding an edge of a held wafer.

12. The combination as set forth in claim 9 which further comprises means for evacuating said housing to remove debris ground from an edge of a wafer.

13. The combination as set forth in claim 1 which further comprises means for moving said grinding wheel towards said chuck to pass an edge of a wafer on said chuck through said seal assembly and into said housing.

* * * * *